US005574436A

United States Patent [19]

Sisselman et al.

[11] Patent Number: 5,574,436

[45] Date of Patent: Nov. 12, 1996

[54] SMOKE DETECTOR INCLUDING AN INDICATOR FOR INDICATING A MISSING PRIMARY POWER SOURCE WHICH IS POWERED BY A SUBSTANTIALLY NONREMOVABLE SECONDARY POWER SOURCE

[76] Inventors: Ronald Sisselman, 4626 Hazleton La., Lake Worth, Fla. 33467-8634; Gerald D. Rork, 924 Willow La., Sleepy Hollow, Ill. 60118

[21] Appl. No.: 95,289

[22] Filed: Jul. 21, 1993

[51] Int. Cl.[6] ..... G08B 21/00; G08B 17/10; G08B 23/00

[52] U.S. Cl. ..... 340/663; 340/628; 340/636; 340/693

[58] Field of Search ..... 340/693, 635, 340/636, 663, 628, 629, 630, 514, 660, 661, 662, 664

[56] References Cited

U.S. PATENT DOCUMENTS

| | | | |
|---|---|---|---|
| 3,594,751 | 7/1971 | Ogden | 340/228 |
| 4,155,081 | 5/1979 | Haglund | 340/629 |
| 4,228,428 | 10/1980 | Niedermeyer | 340/628 |
| 4,290,057 | 9/1981 | Knight | 340/693 |
| 4,380,760 | 4/1983 | Kornblit | 340/663 |
| 4,453,222 | 6/1984 | Goszyk | 340/663 |
| 4,761,631 | 8/1988 | Hwang | 340/52 D |
| 4,785,293 | 11/1988 | Shearer et al. | 340/628 |
| 4,827,244 | 5/1989 | Bellavia | 340/514 |
| 4,870,395 | 9/1989 | Belano | 340/693 |
| 4,881,063 | 11/1989 | Fawcett | 340/693 |
| 4,929,931 | 5/1990 | McCuen | 340/636 |
| 4,959,640 | 9/1990 | Hall | 340/693 |
| 5,055,830 | 10/1991 | Cousins | 340/693 |
| 5,103,216 | 4/1992 | Sisselman | 340/693 |
| 5,444,434 | 8/1995 | Serby | 340/628 |

OTHER PUBLICATIONS

*Electronics Products,* Mar. 1992, Chin, "Energy Storage device promises benefits for low-drain applications".

ULTRALIFE® Lithium Power Cell product brochure, Ultralife Batteries, Inc. 1991.

*Primary Examiner*—Victor R. Kostak
*Assistant Examiner*—John W. Miller
*Attorney, Agent, or Firm*—Woodard, Emhardt, Naughton, Moriarty & McNett

[57] ABSTRACT

A smoke detector having an audible missing primary power source indicator, capable of indicating the absence of a primary power source powering the detector is provided. A missing power source circuit, including a supplementary power source having an effective voltage below a predetermined reference value is connected in parallel with the primary power source of the smoke detector. Additionally, the smoke detector contains low voltage detection and alarm circuitry, connected to the primary and supplementary power sources, to produce an audible warning when the effective voltage powering the smoke detector is determined to be below a predetermined reference value. Primary power to the detector may be supplied by a DC battery, a DC power source which has been converted from AC power or by a combination of the two. In one embodiment of the present detector, the supplementary power source has been rendered substantially non-removable by a consumer to prevent a consumer from disabling the missing power source indicator by removing the supplementary power source. For example, in one embodiment of the present invention, the supplementary power source of the present invention is a battery which has been completely enclosed in plastic, thus being rendered substantially non-removable by a consumer in the absence of using physical force to alter the smoke detector circuitry or housing.

19 Claims, 8 Drawing Sheets

SMOKE DETECTOR INCLUDING AN INDICATOR FOR INDICATING A MISSING PRIMARY POWER SOURCE WHICH IS POWERED BY A SUBSTANTIALLY NONREMOVABLE SECONDARY POWER SOURCE

BACKGROUND OF THE INVENTION

This device relates generally to the field of smoke detectors and more particularly to a smoke detector having an audible indicator for warning of the absence of the primary power source powering the smoke detector, whether that primary power source is a battery, an AC power source, or an AC power source with battery back-up.

It has been determined that many fire related fatalities may have been avoided if the victims had been provided with adequate warning of a fire provided by an operating smoke detector. Many times, a smoke detector is present but a missing battery or the disconnection of the AC power to a smoke detector results in a lack of power necessary to operate the smoke detector. This results in a lack of adequate warning of the presence of smoke and fire. As such, it has been recognized in the art of smoke detectors that it is useful to provide a smoke detector having a visible indicator to warn the consumer that a smoke detectors primary power source has been disconnected. U.S. Pat. Nos. 4,228,428, 4,881,063, 4,959,640, 5,055,830, and 5,103,216 relate to smoke detectors that provide a visual indicator if a battery is not installed in the smoke detector. U.S. Pat. No. 4,870,395 shows a smoke detector having a safety lockout system that prevents securing the body of the smoke alarm to the mounting bracket prior to the installation of a battery.

Additionally, U.S. Pat. No. 3,594,751 describes a smoke detector having a primary battery and a standby or replacement battery, and circuit means causing the standby battery to continually monitor the strength of the primary battery and to give a supervisory warning to the homeowner when the strength of the primary battery falls below a predetermined value, whereby the homeowner is warned to replace the primary battery with the standby battery and to secure in a reasonable time a fresh replacement for the standby battery. A new battery should be installed as promptly as reasonably possible into the supervisory position or supervision will be lost. In any event, according to the patent, the supervisory circuit (assuming a charged battery is in position in the supervisory circuit) will always inform the homeowner or proprietor of the fact that the primary battery is due to be replaced.

U.S. Pat. No. 4,761,631 discloses a vehicular burglar alarm system with a backup battery which supplies power to a vehicle alarm system. The main battery charges and maintains a backup battery in full charge, and when the main battery is disconnected or damaged, the backup battery provides power to an alarm and a control circuit triggers a siren to give warning.

U.S. Pat. No. 4,929,931 discloses a battery monitor for monitoring a plurality of conditions of a battery utilized within a system as the primary or auxiliary power source of the system. A processor utilizes a voltage measurement to determine the presence or the absence of the battery, whether the battery voltage is equal to or greater than a nominal voltage level, and whether the discharge rate of the battery is greater than a selected discharge rate.

None of the above systems, however, takes into consideration the possibility that the user of the smoke detector may have intentionally disabled the power source to the detector, rendering it inoperable, and may thereafter lack the proper motivation to replace or reconnect power to the detector. For example, it is not uncommon for a consumer to purposely remove a battery from a battery powered smoke detector, or an AC detector having a battery backup, to use the battery in another household appliance. Further, that same consumer may lack the motivation to replace the borrowed battery. When a fire occurs, (and in the case of AC units having a battery backup, when the AC power supplying the detector goes out), the consumer's battery operated appliance may work, but their smoke detector will not.

A second common problem with battery powered detectors involves the low battery warning signal built into battery powered and battery backup smoke detector circuits. When a smoke detector battery becomes low, the horn will periodically emit an annoying 'chirp' sound. Many people will disconnect or remove the battery so as to discontinue the 'chirp' warning and will, again, lack sufficient motivation to replace the battery, thus leaving the detector unpowered.

Further, if a smoke detector is improperly located too close to sources of combustion, in a kitchen for example, a person may remove the battery or disconnect the AC power source to the unit to prevent annoyance caused by nuisance activations.

Additionally, conventional AC powered smoke detectors have no easily discernible way of alerting the user that the AC power has been removed or disconnected from the detector. In many cases, all of the AC powered smoke detectors in a home may be part of the same electrical circuit and may all be be connected to the same circuit breaker. If that circuit breaker were to open due to a short or other abnormality in the circuit, or if a power outage were to occur, a consumer may never be alerted to the fact that some or all of the AC powered smoke detectors have been disabled. Normally, consumers will presume that an AC detector is powered and fail to test such a unit.

None of the prior art smoke detector systems provides the consumer with an audible warning that the primary power source to the detector has been disconnected and also provides the consumer with sufficient motivation to promptly reconnect the primary power source to a disabled smoke detector.

It is therefore desirable to provide an audible warning system that alerts the consumer that the primary power source to an AC-powered, AC-powered with battery backup, or battery-powered smoke detector has been disabled. It is additionally desirable to provide a smoke detector having a means to provide a consumer (or anyone else within hearing range) with sufficient motivation to replace or reconnect the power source to a disabled smoke detector so that it will be operable in the event of a fire.

SUMMARY OF THE INVENTION

Briefly describing one aspect of the present invention a smoke detector having an audible missing power source indicator for warning a consumer that the primary power source to the smoke detector has been disabled is provided.

Another object of the present invention is to provide a smoke detector having an audible missing power source indicator designed to prompt a consumer to replace or reconnect a disabled primary power source to the detector.

A further object of a preferred embodiment of the present invention is to provide a smoke detector having a missing power source indicator, comprising:

a primary power source means for providing power to the smoke detector;

smoke detection and indication means, connected to the primary power source means, for detecting and indicating the presence of smoke;

missing power source indicator means for indicating the absence of the primary power source means; and supplementary power source means, connected to the missing power source indicator means, for providing power to the missing power source indicator means in the absence of power from the primary power source means, wherein the supplementary power source means is substantially non-removable from the smoke detector by a consumer.

Further objects and advantages of the present invention may be discerned by persons of ordinary skill in the art after reviewing the following written description and accompanying figures.

DESCRIPTION OF THE PREFERRED EMBODIMENT

Figure 1:
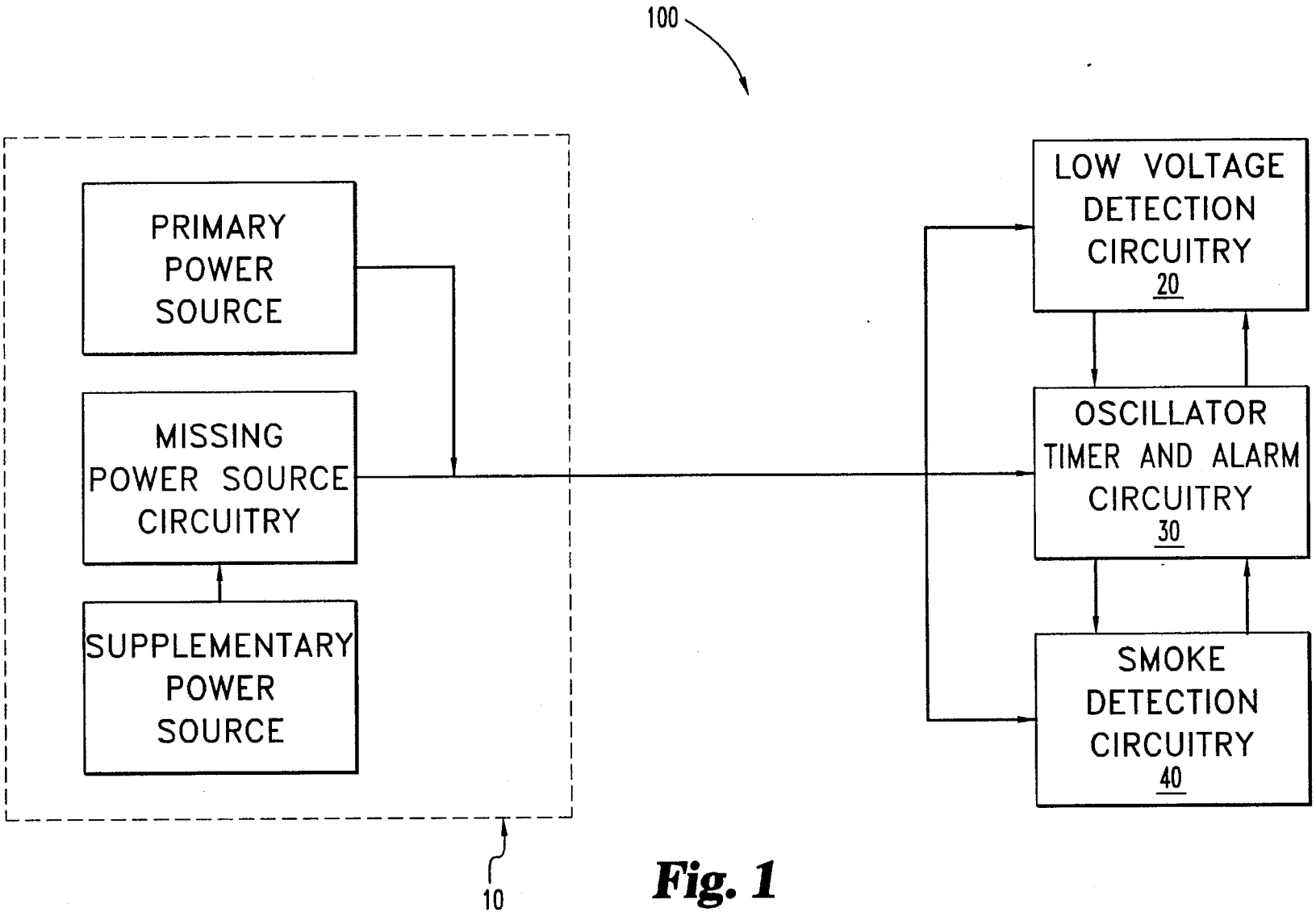
FIG. 1 is a simplified block diagram of the circuitry for a smoke detector having a missing power source indicator in accordance with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In the preferred embodiment of the present invention, a smoke detector having an audible missing power source indicator is provided to audibly indicate to a consumer that the primary power source providing power to a smoke detector has been disabled. In a first preferred embodiment, low voltage detection circuitry is used to detect a reduced voltage supplied by a supplementary power source in the absence of the primary power source to the detector. Additionally, the supplementary power source of the preferred embodiment is simultaneously used to give the missing power source warning and to power the smoke detector. Such low voltage detection circuitry may be added to the smoke detector of the present invention, or the low voltage detection circuitry already present, as in battery powered and AC powered with battery backup detectors.

It is common for battery powered or AC powered with battery backup smoke detectors to include in the smoke detector a low battery voltage warning circuitry. The low battery detection circuitry already incorporated into a battery powered smoke detector may be contained on a single integrated circuit chip, such as the MC14466, MC14467-1 or the MC14468, all made by MOTOROLA. This low battery warning circuitry is often powered by the primary power source providing power to the circuit, the voltage level of which is periodically checked. One embodiment of the present invention, as disclosed herein, provides a missing power source indication when the primary power source to a smoke detector has been disabled, using existing low battery circuitry in the detector. Additionally, in AC powered units or other types of units not already having low battery/voltage warning circuitry, such circuitry may be added in connection with the missing power source indicator of the present invention.

Referring now to FIG. 1, there is shown a block diagram of the smoke detector circuitry having an audible missing power source indicator 100 in accordance with a preferred embodiment of the present invention. In ordinary operation, the smoke detector circuitry 100 of FIG. 1 will operate to indicate the presence of smoke, using the smoke detection circuitry 40 in combination with the oscillator timer and alarm circuitry 30. Additionally, smoke detector 100 will operate to indicate when the voltage of a primary power source has dropped below a predetermined voltage level, if at the time of such a detection, primary power is supplied by a battery, using the low voltage detection circuitry 20 in combination with the oscillator timer and alarm circuitry 30. Further, using a supplemental power source and missing power source circuitry in combination with the low voltage detection circuitry 20 and the oscillator timer and alarm circuitry 30, as shown in FIG. 1, the smoke detector circuitry 100 will operate to indicate that the primary power source to the detector has been disabled. The missing power source circuitry of the preferred embodiment of the present invention operates to supply a voltage below a predetermined reference voltage level to the low voltage detection circuitry, which will cause an audible warning 'chirp' to sound indicating the non-functional primary power source. In the present embodiment, this low voltage warning 'chirp' will be identical to the low battery voltage warning signal normally sounded by battery powered detectors when a low battery voltage is detected. As stated above, the traditional low battery voltage warning circuitry can be incorporated into AC powered units in connection with the present invention.

Figure 3:
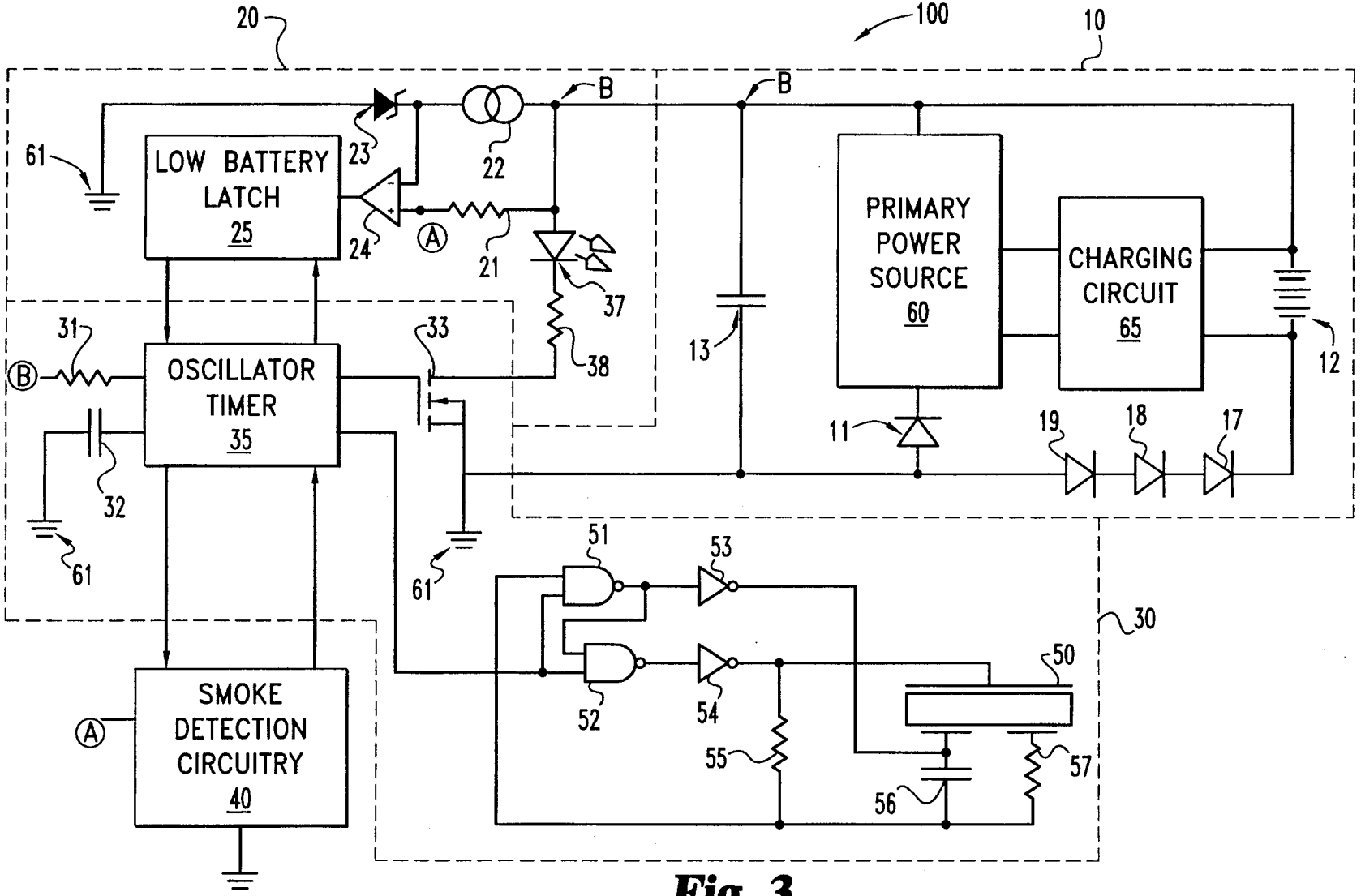
FIG. 3 is a more detailed circuit diagram of the smoke detector having a missing power source indicator of FIG. 2.
Figure 4:
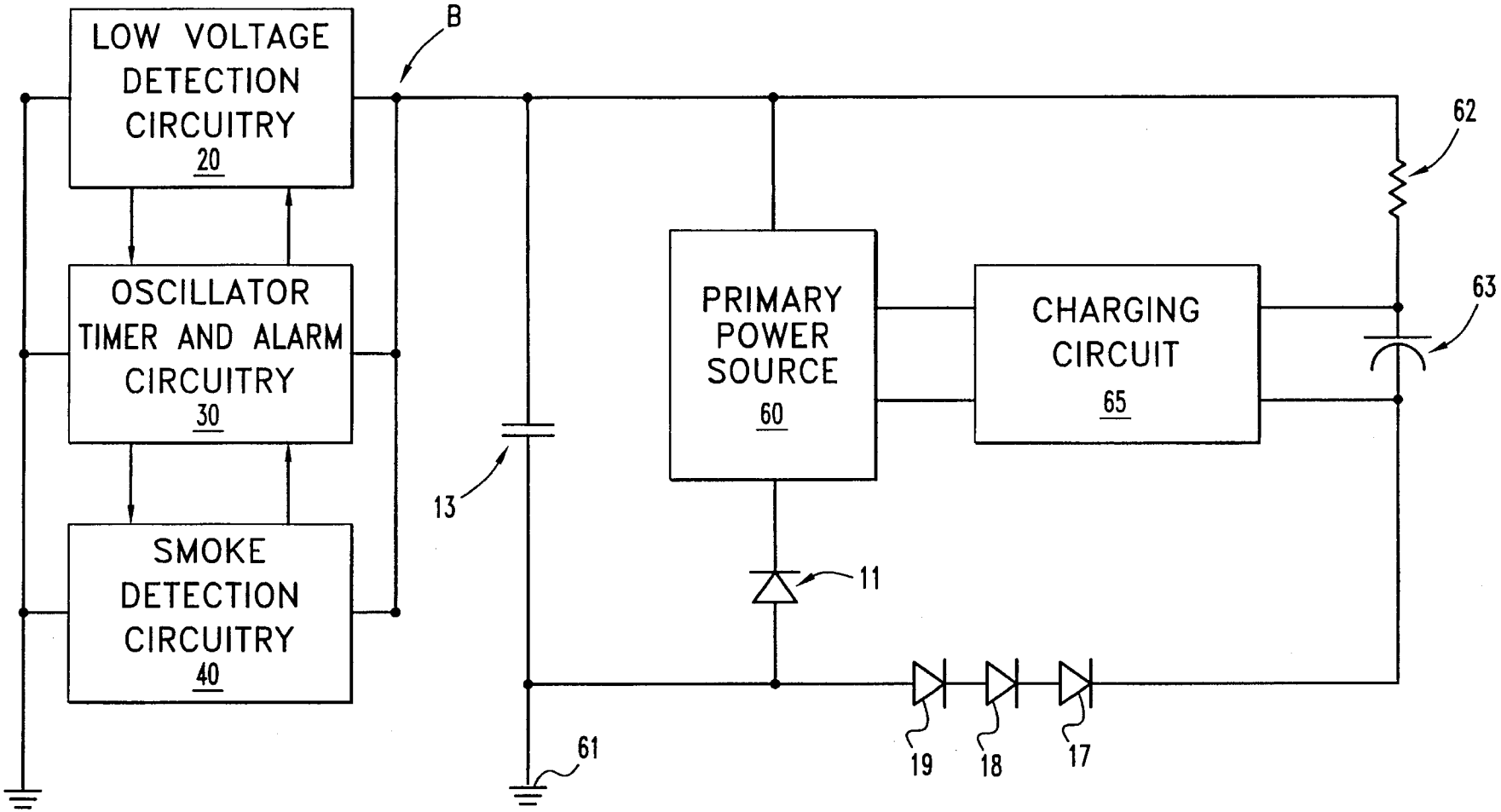
FIG. 4 is a diagram of a further embodiment of the smoke detector having a missing power source indicator of the present embodiment.
Figure 5:
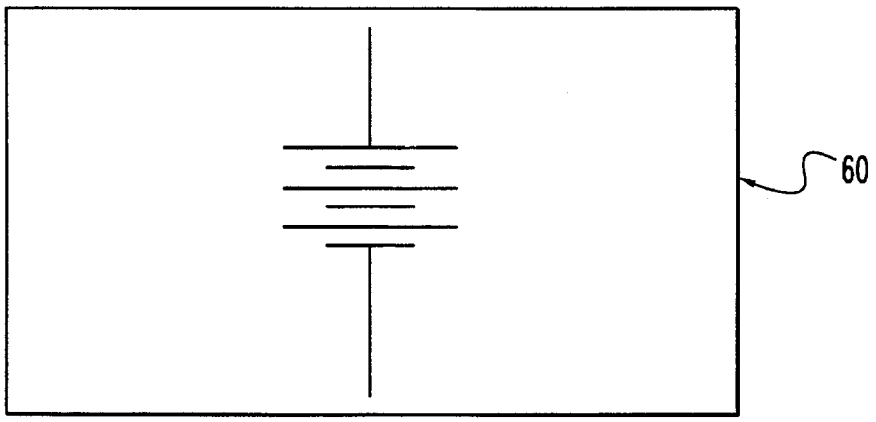
FIGS. 5–7 are alternate representations showing the multiple forms and combinations possible for the primary power source powering the smoke detector of the present invention.
Figure 6:
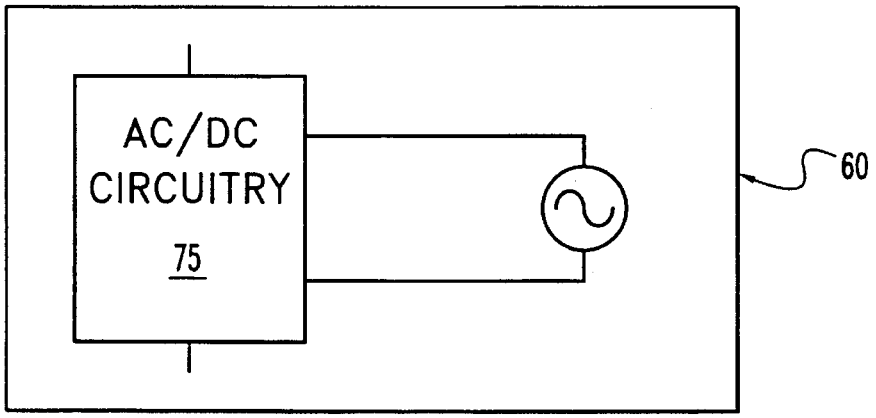
Figure 7:
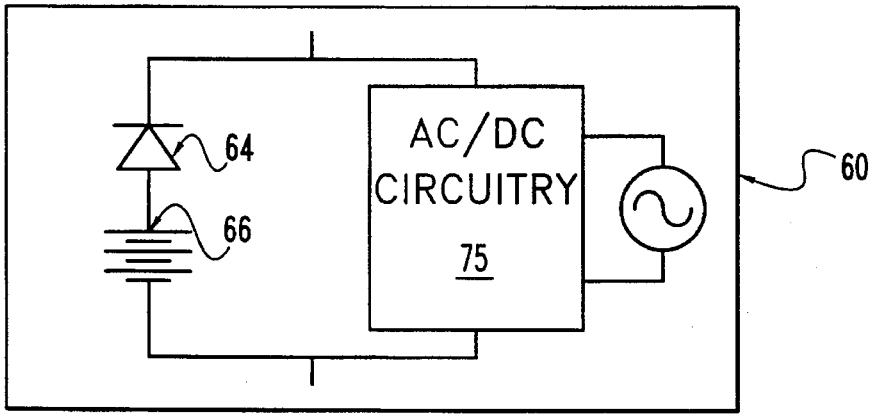

In operation, the smoke detector having an audible missing power source indicator 100 is powered by a primary power source 60 (FIGS. 2–7). As will be described in connection with FIGS. 5–7, the primary power source of the detector 100 of the present invention may be chosen from among the group of common smoke detector power source types. For example, the primary power source of the present invention may be either a battery, as shown in FIG. 5, a DC power source converted from AC power using a bridge circuit or other type of AC to DC converter, as shown in FIG. 6, or a DC power source converted from AC power which additionally includes a backup battery 66 to supply a DC voltage in the absence of AC power, as is shown in FIG. 7. The primary power source 60, which is connected in parallel with the missing power source circuitry and supplemental power source as shown in FIG. 1, is initially used to power the smoke detection circuitry 40, the oscillator timer and alarm circuitry 30 and the low power detection circuitry 20. In the preferred embodiment of the present invention, the primary power source is designed to initially supply 9 DC Volts +/– 1 volt when it is at its maximum voltage level. The operation of the smoke detection circuitry 40 of the preferred embodiment of the present invention is known in the smoke detector art and can be similar to that disclosed in U.S. Pat. No. 4,827,244, incorporated by reference herein. In normal operation, in the presence of combustion products the impedance of an active ionization chamber located within the smoke detection circuitry 40 will increase. When the voltage at an electrode reaches the reset level at the external reference, as determined by a potentiometer, an output will be produced from a smoke comparator within the smoke detection circuitry 40, which will activate the horn driver, which is part of oscillator timer and alarm circuitry 20. The associated horn will remain activated as long as the amount of combustion products is sufficient to maintain the voltage at the electrode at or above the external reference.

Likewise, the low battery detection circuitry is additionally known in the smoke detector art, see U.S. Pat. No. 4,827,244 previously incorporated by reference herein. When the voltage level of the primary power source drops below a reference level, an output will be produced from the low voltage detection comparator located within the low voltage detection circuitry 20, which will activate the horn driver, which is part of oscillator timer and alarm circuitry 30. So long as the voltage detected by the low voltage detection circuitry 20 is below the reference level, the oscillator timer circuitry will periodically activate the horn driver, which will cause a horn output to be produced. In the preferred embodiments of the present invention, the reference voltage level is between 7.2–7.8 volts for a primary power source having 9 DC Volts, although the reference voltage level can be adjusted by adding additional resistors to the circuit.

The missing power source circuitry of the present invention, shown with the primary power source in box 10 of FIG. 1, is connected to the supplementary power source, which is connected in parallel with the primary power source of the present system. The supplementary power source of the present invention may comprise a supplementary power source initially having a true voltage below the predetermined reference voltage, but still sufficient to cause the low voltage warning circuitry to sound. For example, a single battery may be used having a voltage below the predetermined reference voltage, yet greater than the low voltage operations minimum, below which the low voltage detection circuitry will not operate. In such a case, the missing power source circuitry may consist only of a reverse charging diode. Likewise, several smaller voltage batteries may be serially connected to supply a voltage below the predetermined reference voltage, but above the operations minimum for the smoke detector circuitry. Additionally, as detailed herein in connection with FIGS. 2–4, the missing power source indicator circuitry of the present invention may include circuitry which will reduce the true initial voltage of a supplementary power source, i.e. a 9 volt battery, to an effective voltage below a reference voltage level but above an operations minimum required to operate the smoke detector, if the supplementary battery is to be used to power the detector in the absence of the primary power source. If the primary power source of the present invention is removed, the detection of a true or effective supplementary power source voltage below the reference voltage level will cause a warning 'chirp' identical to the detectors low battery warning 'chirp' to periodically sound.

Figure 2:
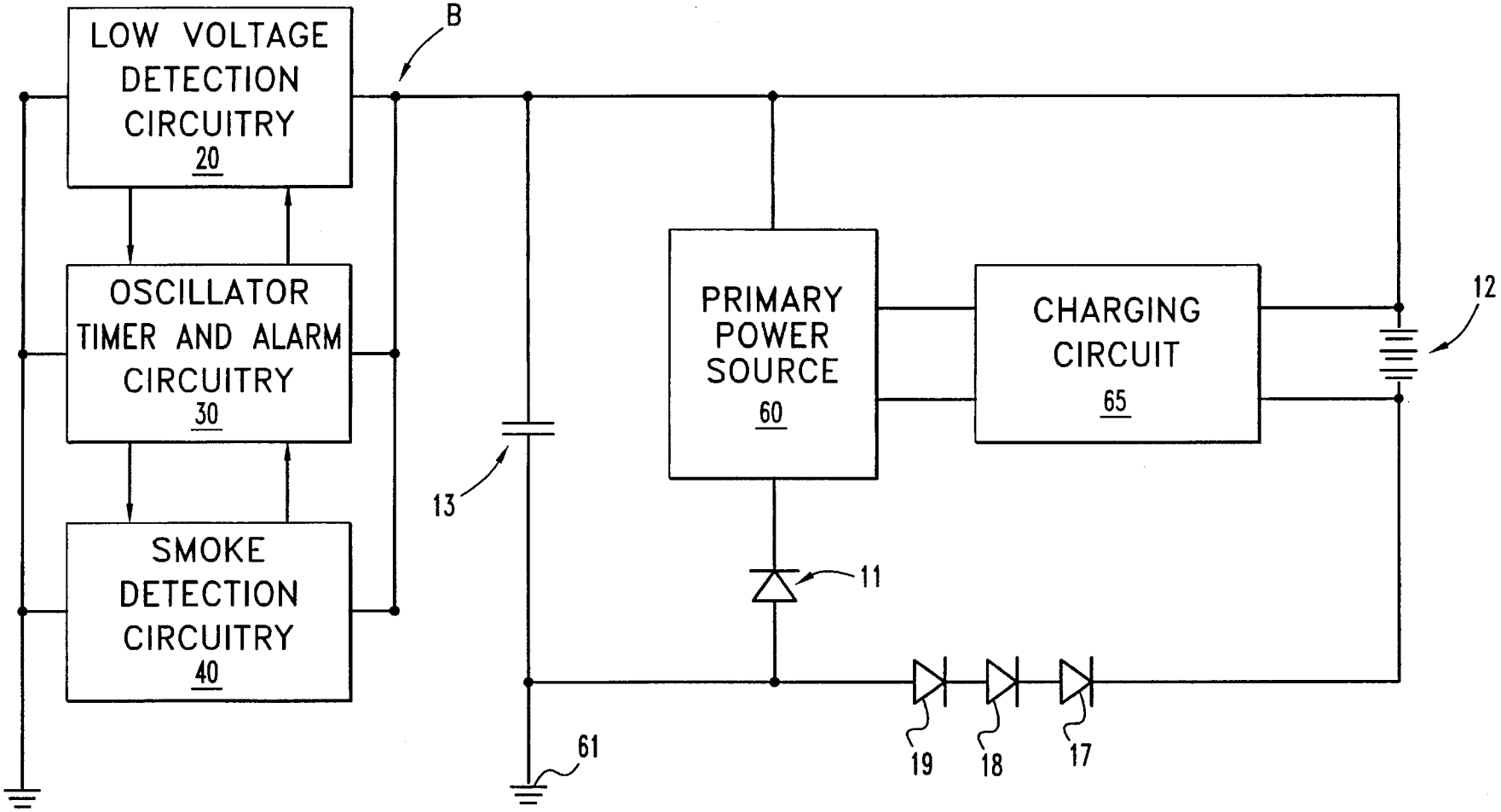
FIG. 2 is a diagram of a smoke detector having a missing power source indicator in accordance with an embodiment of the present invention.

Further, if a capacitor or a rechargeable nickel-cadmium battery is used in connection with the missing power source indicator circuitry as the supplementary power source, an optional charging circuit 65 (FIGS. 2 and 4) may be included in the smoke detector 100 of the present invention. However, a charging circuit is unnecessary if the supplementary power source is, for example, a lithium battery having a shelf life of 10 years or greater. As such, the diagram of the smoke detector circuitry 100 shown in FIG. 2 shows an optional charging circuit 65. Charging circuits are additionally known in the smoke detector art. For example U.S. Pat. No. 4,155,081 shows a recharging circuit for an AC powered smoke detector having a battery backup, that patent being herein incorporated by reference.

Additionally, since the supplementary power source of the preferred embodiment of the present invention is connected in parallel with the primary power source, once the primary power source has been disabled (i.e. disconnected or having a voltage below the voltage required for smoke detector operation), the supplementary power source will power the smoke detector at a diminished voltage level until either primary power is returned to the smoke detector circuitry 100 or until the voltage of the supplementary power source falls below a minimum voltage sufficient to power the smoke detector circuitry 100. As such, the charging circuit 65 would be useful for recharging a supplementary power source that has been used to power the smoke detector for a prolonged period of time.

Referring now to FIGS. 2 and 3, there is shown a first preferred embodiment of the smoke detector having a missing power source indicator of FIG. 1. Components shown in more than one figure use the same reference number in all figures. Many of the components shown in connection with the low voltage detection circuitry 20, oscillator timer and alarm circuitry 30, and the smoke detection circuitry 40, may be incorporated onto a single integrated circuit chip, such as the MC14466, MC14467-1 or the MC14468, all made by MOTOROLA.

The primary power source and missing power source circuitry of box 10 of the present invention includes a primary smoke detector power source 60 having a negative voltage terminal connected to the reverse charging diode 11. The reverse charging diode prevents current flow from the supplementary power source if the voltage of the primary power source is lower than that of the secondary power source. The anode of the reverse charging diode 11 is connected to a reference or ground potential 61. Initially, power is supplied to all parts of the circuit from the primary power source 60, at voltage node B.

Additionally, the missing power source circuitry of box 10 includes the diodes 17, 18, 19 and 11. A supplementary power source 12 has a negative terminal which is connected to the cathode of the first of three serially connected diodes 17, 18 and 19. The anode of the third diode 19 is connected to the anode of reverse charging diode 11 and additionally to the ground potential 61. In this first preferred embodiment of the invention shown in FIG. 2, the supplementary power source 12 may be a 9 volt lithium power cell such as is made by ULTRALIFE BATTERIES Inc. of Newark, N.Y.. The ULTRALIFE lithium power cell has been reported to have a shelf life of up to 10 years.

The missing power source circuitry may optionally contain a filter capacitor 13 connected in parallel with the primary power source 60. Periodically, about every 40–48 seconds as will be described in connection with the oscillator timer 35, the oscillator timer pulses the LED by turning on the MOSFET 33. If the primary power source is missing, due to the reduced effective voltage attributable to the supplementary power source 12 resulting from the voltage drop caused by the serially connected diodes 17, 18 and 19, the low voltage detection circuitry will create a low voltage output, as will be described in connection with the low voltage circuitry 20, and will activate the horn to sound a warning 'chirp'. The diodes 17, 18 and 19, cause the true voltage of the supplementary power source 12 to be reduced by three voltage drops. This results in an effective voltage measured at voltage node B which is below the predetermined reference voltage required to cause the low voltage detection circuitry to sound a warning. It would additionally be possible to replace the diodes 17 and 18 and with a resistor, the value of which has been chosen to replicate the desired voltage drop.

In effect, the supplementary power source 12 is shut off while the primary power source 60 is present and is greater than the "effective"(meaning the true voltage minus any diode drops that may be present) voltage of the supplementary power source. This results in no current being drawn from the supplementary power source 12 when the primary power source is present.

Referring more particularly to FIG. 3, there is shown the oscillator timer and alarm circuitry 30 of the present invention, which includes an oscillator timer 35, the timing constant of which is set by resistor 31 and capacitor 32. In the preferred embodiment of the present invention the period of the internal oscillator is designed to be 1.67 seconds under non-smoke conditions, and 40 milliseconds under smoke conditions. As such, in the present invention it is recommended that timing capacitor 32 be 0.1 microfarads and resistor 31 have a value of 8.2 Mohms. Additionally, resistor 31 is connected to voltage node B in order to supply power to the oscillator timer and alarm circuitry. The oscillator timer and alarm circuitry 30 of the present invention also includes a horn driver circuit comprising nand gates 51 and 52, connected in a feedback configuration, inverters 53 and 54, capacitor 56 and resistors 55 and 57 connected to a feedback operated piezoelectric horn 50.

Additionally, the oscillator timer 35 includes a terminal connected to the gate of an n-channel enhancement mode MOSFET 33, the source of which is connected to the ground potential 61. The drain of MOSFET 33 is connected to the second terminal of resistor 38 which is part of the low voltage detection circuitry 20. Periodically, the oscillator timer 35 will strobe, providing a signal at the gate of MOSFET 33. When this occurs, MOSFET 33 will turn on, creating a channel from the drain to the source of MOSFET 33 and a path to the ground potential 61 will be created through LED 37, resistor 38. LED 37 and resistor 38 are chosen so that when MOSFET 33 is conducting, a 10 milliamp load is applied to the power source supplying voltage node B.

Additionally, the low voltage detection circuitry 20 includes a low battery comparator 24 having a reference input terminal which is connected to an internal reference voltage provided by a current source 22 connected to the effective power source supplying voltage node B. The reference voltage is regulated by a zener diode 23. The anode of the zener diode 23 is connected to the ground potential 61. The effective voltage supplying voltage node B is connected via a resistor to the second input terminal of the comparator 24. Every 24 clock cycles a check is made for a low voltage by comparing the voltage at voltage node B to the internal reference voltage, set by zener diode 23. The output of the comparator 24 is connected to a low battery latch 25. The low battery comparator 24 information is latched into the low battery latch 25. If the output of comparator 24 indicates that the voltage at node B is below the reference voltage level, the state of the low battery latch 25 will change, indicating that a low power source warning chirp should be sounded.

The missing power source circuitry shown in FIGS. 2–4, have been designed to provide an effective voltage at voltage node B below the internal reference voltage set by the zener diode 23. As such, when the primary power source 60 is removed, the comparator 24 will produce a low voltage output causing the horn driver to cause a warning chirp to be sounded by the horn of the alarm circuitry portion of the oscillator timer and alarm circuitry 30. The warning chirp will warn a consumer to check the detector for a low or missing primary power source. Every 40–48 seconds, oscillator timer 35 will cause MOSFET 33 to turn on for about 10–12 milliseconds, thus drawing a 10 milliamp load from the effective voltage supplying voltage node B and causing LED 37 to be pulsed. During this time the output from the comparator 24 will be reported to the low battery latch 25. If the low battery latch indicates that the voltage at voltage node B is low, the horn driver will activate the horn 50 for a period of 10–12 milliseconds. This results in a low/no battery warning 'chirp' alerting the consumer as to a problem with the detector. The periodic warning 'chirp' creates a feeling of lesser urgency than that of the continuously sounding horn warning attributable to the detection of smoke and is serves as a reminder to replace or reconnect the primary power source. Thus a consumer can easily distinguish between the low/no battery warning and the smoke detection warning.

Figure 8:
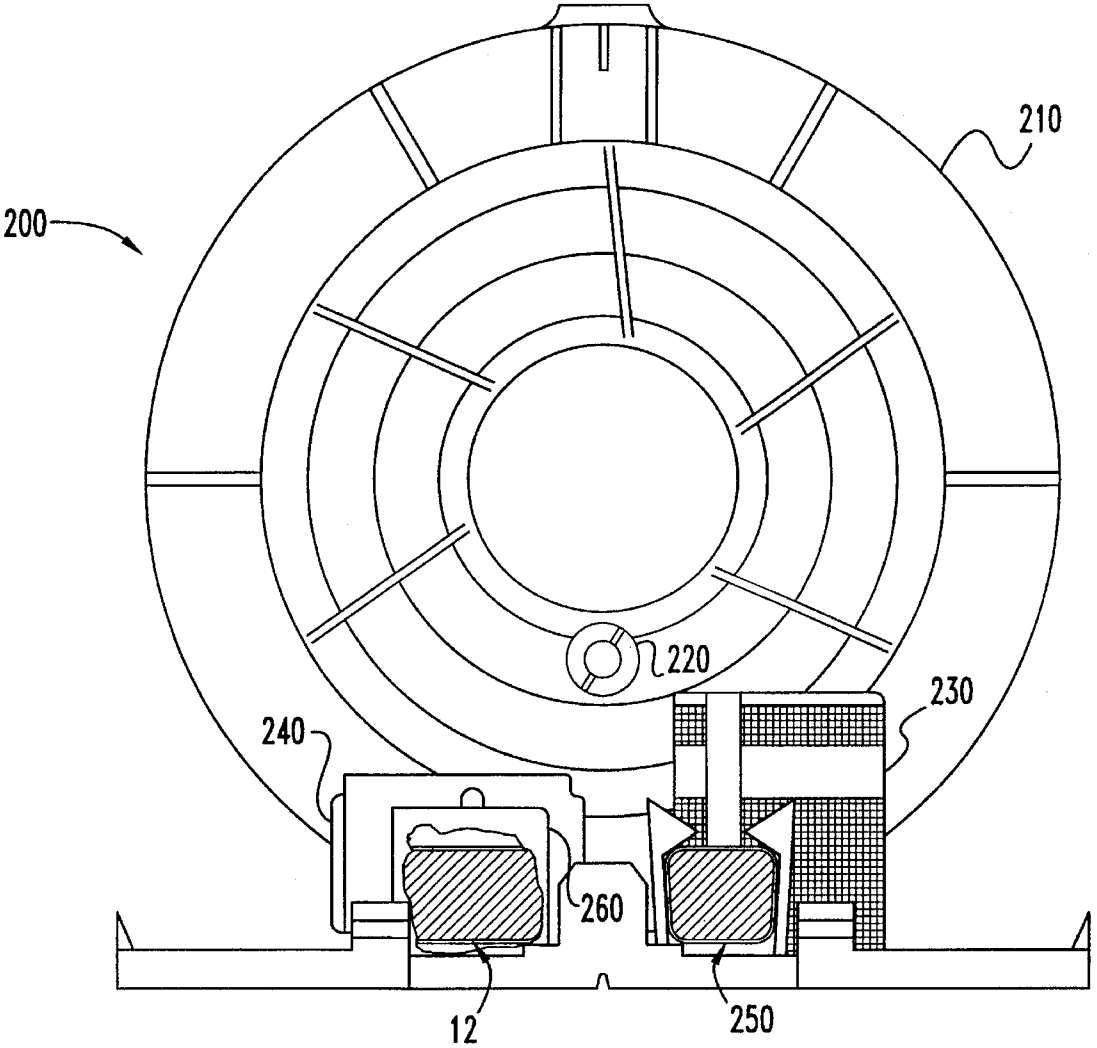
FIG. 8 is a front view of one embodiment of the smoke detector of the present invention having an easily accessible primary power source and a substantially non-removable supplementary power source for powering the missing power source indicator circuitry of the present invention.

If the primary power source 60 supplying voltage node B is a DC power source converted from AC power, as shown in FIG. 6, the value latched into the low voltage latch 25 will not change state unless there is a major disruption of the AC power supplying the circuit, thus rendering the smoke detector insensitive to minor fluctuations in the AC power. If the primary power source 60 is AC having a battery backup, as shown in FIG. 7, or battery powered, as shown in FIG. 8, then the low voltage detection circuitry will cause the low voltage latch to lock into the low voltage state when AC power is absent and the voltage at voltage node B is either below the required reference voltage resulting from either a low or missing primary power source 60. The voltage measured at voltage node B is attributable to different sources during the operation of smoke detector 100. For example, when the primary power source 60 is present and greater than the effective voltage due to the supplementary power source, the voltage seen at voltage node B can be attributed to the primary power source 60. If the primary power source 60 is missing, the voltage at voltage node B is attributable to the reduced effective voltage of the supplementary power source 12. If the primary power source 60 is a battery, the voltage of which has dropped to a level close to that of the effective voltage of the supplementary power source 12, then the voltage at voltage node B is the voltage of the primary power source connected in parallel with the effective voltage of the supplementary power source 12. The results of the different states of the primary and supplementary power sources are illustrated in Table 1. The voltage level of the primary power source shown in Table 1 is measured with reference to the internal reference voltage, whereas the voltage level of the supplementary power source in Table 1 is referenced to the optimal effective supplementary power source voltage.

TABLE 1

| PRIMARY POWER | EFFEC. SUPP. POWER | RESULT |
|---|---|---|
| ABSENT | HIGH | CHIRP |
| HIGH | HIGH | NO CHIRP |
| LOW | HIGH | CHIRP |
| HIGH | LOW | NO CHIRP |
| LOW | LOW | CHIRP |

It is possible to test for the operability of the missing power source circuitry and supplementary power source by purposely removing the primary power source from the smoke detector and listening for a warning 'chirp' from the detector. If after one minute, the smoke detector alarm circuitry has not emitted a warning 'chirp', the consumer is alerted that the supplementary power source is no longer effective, which will alert the consumer to replace the smoke detector.

Referring now to FIG. 4, there is shown a second preferred embodiment of the present invention. The low power detection circuitry 20, oscillator timer and alarm circuitry 30, and smoke detection circuitry 40 are identical to those circuitry portions shown in FIG. 3, and as such will not be repeated in connection with FIG. 4. The operation of the diagram of FIG. 4 is virtually identical to that of the circuit of FIG. 3, with the exception that battery 12 has been replaced by capacitor 63 and resistor 62. Capacitor 63 can be quickly charged to the same value as the primary power source 60. The resistor 62 must be chosen to be sufficiently large to control the slow discharge of capacitor 63 once the primary power source 60 has been removed. Thus, the capacitor 63 can be charged rapidly and discharged more slowly in order to permit a warning of some duration. Otherwise, the circuit shown in FIG. 4 functions identically as the circuit illustrated in connection with FIGS. 2 and 3.

The primary power source 60 is again connected in parallel with an optional filter capacitor 13 and the supplementary power source capacitor 63. Further, the cathode of a reverse charging diode 11 is connected to the negative terminal of the primary power source 60. The anode of the reverse charging diode 11 is connected to the ground potential 61. The reverse charging diode prevents current flow from the supplementary power source if the voltage of the primary power source is lower than that of the secondary power source.

The first lead of the capacitor 63 is connected to a first terminal of resistor 62, the second terminal of which is connected to the voltage node B. The second lead of capacitor 63 is connected to the cathode of the first of three serially connected diodes 17, 18 and 19. The anode of diode 19 is connected to the reference potential for the circuit. These diodes, connected in series with the capacitor 63, create a voltage drop, causing the effective voltage of the supplementary power source 63 to be reduced below an internal reference voltage level.

As is explained in connection with FIG. 2, the three serially connected diodes create a voltage drop sufficient to cause a low battery warning chirp when the primary power source 60 is removed from the circuit. Diodes 17 and 18 may be omitted from the circuit, as the drop across resistor 62 should suffice to replace them. The effective voltage at voltage node B is attributable to either the primary power source 60 when the primary power source 60 is much greater than the effective voltage of the supplementary power source, the parallel connection of the effective primary and supplementary power source voltages when the two effective voltages are close, or the effective voltage of the supplementary power source if the primary power source has been removed. The charging circuit 65 may be used to rapidly charge the capacitor 63 from the primary power source 60.

Figure 10:
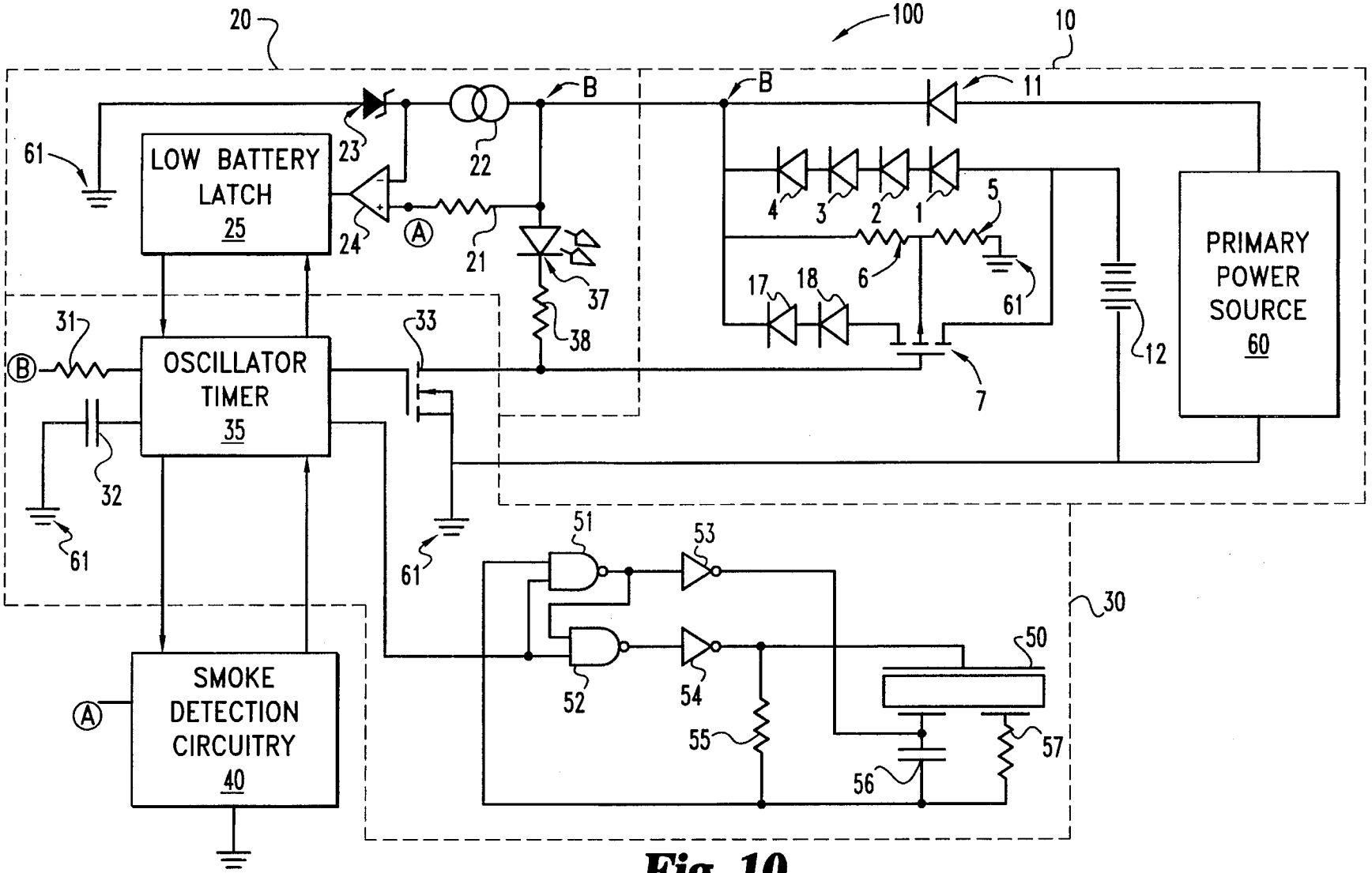
FIG. 10 is a diagram of an alternate embodiment of the smoke detector having an audible missing power source indicator of the present invention.

Alternatively, the missing power source indicator of the present invention may include a transistor, such as a MOSFET, incorporated into the missing power source circuitry as shown in FIG. 10. FIG. 10 shows a P-channel MOSFET 10, the source of which is connected to the positive terminal of the supplementary power source 12. The drain of MOSFET is connected to the voltage node B, through two diodes 17 and 18. Additionally, resistor biasing is provided for the MOSFET by resistors 5 and 6. An alternate current path connects the supplementary power source 12 to the voltage node B, through the diodes 1, 2, 3 and 4. As such, in the absence of the primary power source 60, the detector is initially powered by the supplementary power source 12 via the alternate current path through diodes 1, 2, 3 and 4. About every 40 seconds, as explained in connection with FIG. 3, the oscillator timer circuitry will strobe the MOSFET 33 "on", causing the MOSFET 7 to be conducting. The resulting voltage appearing at voltage node B is due to the current path through the MOSFET 7 when the oscillator is strobed "on". Additionally, if an alkaline battery were used instead of the lithium battery 12, than diode 4 could be omitted from the circuit. Additionally, other transistor circuits can be used to switch the supplementary power source 12 into the circuit when the primary power source 60 is absent.

FIGS. 5, 6 and 7 show alternate forms of primary power sources 60 that may be used in connection with all embodiments of the present invention. As described above, (primary power source 60 of FIGS. 2–4), may be chosen to be either a battery, as shown in FIG. 5, a DC power source converted from AC power, as shown in FIG. 6, or a DC power source resulting either from the conversion of AC power or supplied from a backup battery 66, as shown in FIG. 7. The diode 64 in FIG. 7 will be reverse biased when the AC power is present, and as such, the battery 66 will be effectively switched out of the circuit while the AC power is present.

The above circuitry described in connection with FIGS. 1–7 may commonly be mounted within a smoke detector housing 200 which may be mounted to a ceiling or wall of a business or dwelling. Such circuitry, as has been described above, is designed to give a warning when the primary power source is low or has been disabled. Thus, when the primary power source is purposefully removed from the detector, the supplementary power source will simultaneously power the detector and will periodically emit an annoying 'chirp' warning to prompt the consumer to replace or reconnect the primary power source to the detector. However, it may be desirable to provide a smoke detector having a missing power source indicator, as described in connection with FIGS. 1–7, wherein the supplementary power source powering the missing power source indicator is not easily removable by the consumer. FIG. 8 shows the physical embodiment of one preferred embodiment of the present invention wherein the supplementary power source has been rendered "substantially non-removable" by the consumer.

Referring now to FIG. 8 there is shown a front view of a smoke detector housing 200 of one embodiment of the present invention. Smoke detector lid 210 is connected to the body of the smoke detector casing 200 by a hinged connection and includes a plurality of radial perforations to allow for the passage of smoke particles through the smoke detector housing. A printed circuit board mounted within the smoke detector housing 200 provides a support for the various elements of the smoke detector circuit 100. The front view of the smoke detector housing 200 shows the piezoelectric horn casing 240, the test button 220 and the smoke detector ionization chamber 230. Additionally, in the preferred embodiment shown in FIG. 8, the primary power source 60 of the present embodiment is a battery 250. This is not meant to be limiting, as the primary power source of the present embodiment may be chosen from among those options shown in FIGS. 5–7. The supplementary power source providing power to the missing primary power source indicator circuitry of the present embodiment includes a battery 12, which is completely enclosed in a chamber which, in one preferred embodiment, is made from the same plastic as the smoke detector housing 200 and which is mounted on the printed circuit board. The supplementary power source battery 12 has been effectively rendered inaccessible and non-removable by the consumer. As such, a consumer who has purposefully disconnected the primary power source will be unable to disconnect the supplementary power source. If the primary power source has been disconnected from the detector, the battery 12 will provide power to the missing power indicator circuitry which will cause a warning chirp to sound periodically. This warning chirp may not be readily disabled due to the inaccessible or non-removable nature of the supplementary power source. The annoying chirp warning will prompt the consumer to replace or reconnect the primary power source to the smoke detector. This is true under the theory that it is easier to replace the battery than to destroy the smoke detector.

The description of the present invention is not meant to limit the invention to the embodiment shown in FIG. 8, for example, some smoke detectors may have a supplementary power source, in connection with the circuitry shown in FIGS. 1–7 of the present invention, that is readily accessible to the consumer. In some cases it may be desirable to have an AC powered detector which will alert the user to the absence of the AC power source. Where the primary purpose of the missing power source indicator circuitry is to warn of the absence of the primary power source, a non-removable supplementary power source is not required. However, in smoke detectors wherein the primary purpose is to provide a source of annoyance to prompt a consumer to replace or reconnect the primary power source to the unit and the secondary function is to warn of a missing power source, it is desirable that the supplementary power source be substantially non-removable by the consumer. Additionally, the phrase "substantially non-removable by the consumer" in the context of the present invention is meant to convey that the supplementary power source is not easily removable from the smoke detector without any one or more of the following: removing the smoke detector from the wall or ceiling bracket; using special tools; damaging the smoke detector; or having special knowledge as to the design of the smoke detector circuitry.

It would be possible to use other means or materials to render the supplementary power source substantially non-removable by the consumer. For example, instead of having the supplementary power source completely enclosed in a chamber as shown in FIG. 8, the supplementary power source could be mounted under the circuit board and removal of the supplementary power source would require removal of the circuit board from the detector housing 10. Additionally, the supplementary power source to the detector could be a capacitor, as described in connection with FIG. 4, wherein such capacitor may be mounted to the underside of the circuit board, thus being rendered "substantially non-removable" by the consumer. Additionally, the supplementary power source 12 could be a battery having battery terminals that are soldered to the battery terminals to render it "substantially non-removable" by the consumer. Further, the smoke detector could be designed so as to require a special tool to remove the supplementary power source from connection with the circuit 100. It is within the spirit of the present invention to provide an obstacle to the removal or disconnection of the supplementary power source from the smoke detector circuitry 100 by the consumer.

Figure 9:
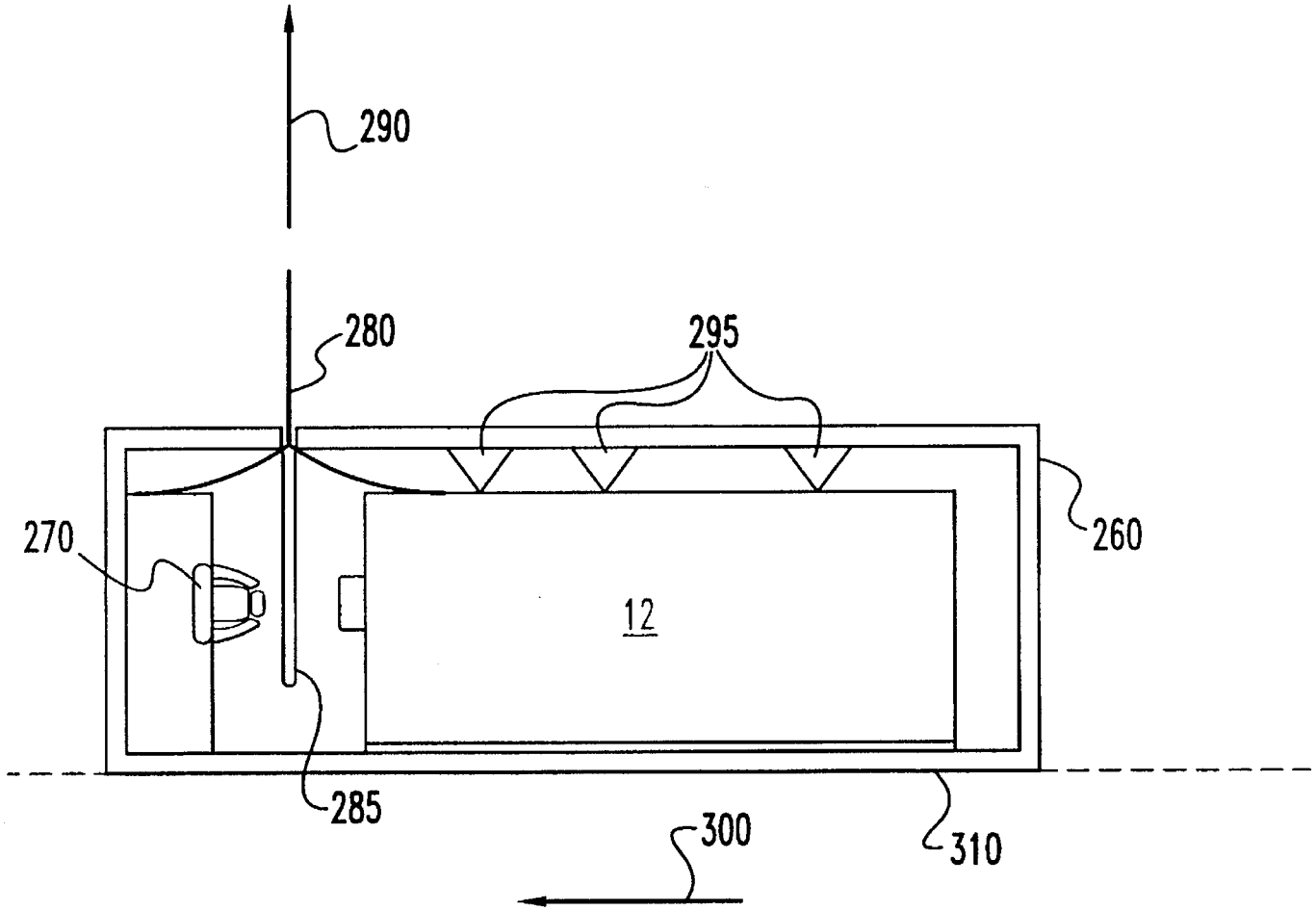
FIG. 9 is a side cut-away view of a chamber containing the supplementary power source of the embodiment of FIG. 8 wherein the supplementary power source is enclosed in a chamber in preparation for connection to the missing power source indicator circuitry of the present invention.

Referring now to FIG. 9 there is shown a side cut-away view of the plastic chamber 260 containing the supplementary power source 12 of the embodiment shown in FIG. 8. A method of connecting the supplementary power source 12 to the battery terminals 270 will now be described in connection with FIG. 8. In the embodiment of the present invention shown in FIG. 8, the supplementary power source 12 is initially slidably enclosed in a plastic chamber 260. At times, it is undesirable for the battery 12 to be connected to the battery terminals prior to installation of the smoke detector. For example, it would be undesirable for a battery 12 to be connected to the circuit 100, in one of the above described embodiments of the circuit of the present invention, while the smoke detector is sitting in a box on a shelf in a retail store. As such, the battery 12 may be initially disconnected from the smoke detector circuit 100 when it is supplied to the consumer. In the embodiment shown in FIG. 8, the battery 12 is initially disconnected from the battery terminals 270 in the plastic chamber 260. Tape pull tab 280 is connected to both the battery 12 and a block supporting the battery terminals 270. Additionally, cardboard separator 285 is attached to the tape pull tab 280 and disposed between the battery 12 and battery terminals 270 to prevent unintentional contact between the battery and the battery terminals prior to connection of the battery 12 to the battery terminals 270. In order to connect the supplementary battery 12 to the battery terminals 270, the tape is grasped firmly by the consumer between the thumb and forefinger and pulled in a direction perpendicular to the position of the battery, as shown by arrow 290. The force exerted on the tape will pull the cardboard insert 285 out from between the battery 12 and the battery terminals 270 and will additionally create a sliding force on the battery 12, pulling the battery 12 in the direction shown by arrow 300, causing the battery 12 to mate with the battery terminals 270. The tape pull tab 280, including the cardboard separator 285, may then be removed and discarded. Reinforcement ribs 295 prevent the battery 12 from being pulled out of proper alignment with battery terminals 270 when a force is exerted on the tape tab 280. In this way, the supplementary power source 12 may be connected to the smoke detector and missing power source indicator circuitry 100 thus readying the smoke detector for operation.

While the invention has been illustrated and described in detail in the drawings and foregoing description, the same is to be considered as illustrative and not restrictive in character, for example, the above described missing power source indicator circuitry can be incorporated into many already existing smoke detector circuit designs, such as that shown in U.S. Pat. No. 4,827,244, that document incorporated herein for all that it shows, without significant modifications. Additionally, the above described smoke detector having a missing power source indicator can be housed in a smoke detector housing having a different form than that shown in FIG. 8. Further, use of the low battery detection circuitry already incorporated into battery powered smoke detectors is optional; additional circuitry could be included to accomplish the audible missing power source indicator of the present invention and still be within the scope and spirit of the present invention. It being understood that only the preferred embodiment has been shown and described and that all changes and modifications that come within the spirit of the invention are desired to be protected.

What is claimed is:

1. A smoke detector having a missing power source indicator, comprising:

primary power source means for providing power to the smoke detector;

smoke detection and indication means, connected to said primary power source means, for detecting and indicating the presence of smoke;

missing power source indicator means for indicating the absence of said primary power source means; and supplementary power source means, connected to said missing power source indicator means, for providing power to said missing power source indicator means in the absence of power from said primary power source means, wherein said supplementary power source means is substantially non-removable from said smoke detector by a consumer.

2. The smoke detector of claim 1, wherein said primary power source includes an AC power source and AC-to-DC conversion circuitry for converting said AC power to DC power.

3. The smoke detector of claim 1, wherein said primary power source includes an AC power source, AC-to-DC conversion circuitry for converting said AC power to DC power, and wherein said primary power source additionally includes a battery for providing backup power when said AC power is disconnected from said smoke detector.

4. The smoke detector of claim 1, wherein said primary power source means includes a battery.

5. The smoke detector of claim 1, wherein said supplementary power source means is additionally connected to said smoke detection and indication means to provide power to said smoke detection and indication means when said primary power source is absent.

6. The smoke detector of claim 1, wherein said supplementary power source means includes at least one battery.

7. The smoke detector of claim 6, wherein said at least one battery includes a 9-volt lithium battery.

8. The smoke detector of claim 1, wherein said supplementary power source is recharged from said primary power source.

9. The smoke detector of claim 8, wherein said supplementary power source consists primarily of a capacitor.

10. The smoke detector of claim 8, wherein said supplementary power source means includes at least one rechargeable battery.

11. A smoke detector having a missing power source indicator, comprising:

primary power source means for providing power to the smoke detector;

smoke detection and indication means, connected to said primary power source means, for indicating the absence of said primary power source means;

supplementary power source means, connected to said missing power source indicator means, for providing power to said missing power source indicator means in the absence of power from said primary power source means, wherein said supplementary power source means is substantially non-removable from said smoke detector by a consumer; and wherein said supplementary power source is sealed within a substantially non-removable chamber connected to a housing containing said smoke detector circuitry.

12. The smoke detector of claim 1, wherein said missing power source indicator means additionally comprises low voltage detection means connected to said primary power source for detecting a voltage and for providing an output when said detected voltage is below a predetermined reference voltage.

13. The smoke detector circuitry of claim 12, wherein said missing power source indicator circuitry comprises at least one diode connected in series with at least one other electrical circuit element capable of providing a voltage drop to reduce the effective voltage of the supplementary power supply below said predetermined reference voltage.

14. The smoke detector circuitry of claim 1, additionally comprising a solid state switch means connected between said supplementary power source means and said missing power source indicator means for connecting said supplementary power source means to said missing power source indicator means when said primary power source is absent.

15. A smoke detector having a missing power source indicator, comprising:

a primary power source for providing power to the smoke detector;

smoke detection circuitry connected to said primary power source for detecting smoke and for providing a smoke detection output when said smoke is detected;

low voltage detection circuitry connected to said primary power source for providing a low voltage output when a detected voltage is below a predetermined reference voltage;

alarm circuitry, connected to said smoke detection circuitry and to said low voltage detection circuitry, for providing an alarm upon the receipt of a smoke detection output or a low voltage output; and a battery, sealed in a plastic chamber and mounted to a housing containing the smoke detector circuitry, and additionally electrically connected in parallel with said primary power source and further connected to at least said low voltage detection circuitry, for providing a voltage below a predetermined reference voltage to said low voltage detection circuitry when said primary power source has been disconnected, said enclosed battery being rendered substantially non-removable by a consumer.

16. The smoke detector of claim 15, wherein said battery provides power to said smoke detector when said primary power source is absent.

17. The smoke detector of claim 16, wherein said missing power source circuitry comprises at least two serially connected diodes, connected in series with said battery, for reducing the actual voltage of said supplementary power source by the value of at least two diode drops.

18. The smoke detector of claim 15, further comprising missing power source circuitry, connected in series with said battery, for causing the actual voltage of said battery to be reduced below a predetermined reference voltage sufficient to cause said low voltage detection circuitry to provide a low voltage output to said alarm circuitry when said primary power source is disconnected from said smoke detector.

19. The smoke detector of claim 17, additionally comprising a transistor switch, the current path of which is connected serially between said battery and said at least two serially connected diodes for connecting said supplementary power source to said low voltage detection circuitry when said primary power source is absent.

* * * * *